US005896860A

United States Patent [19]

Lockett

[11] Patent Number: 5,896,860

[45] Date of Patent: Apr. 27, 1999

[54] SMOKING FILTER

[76] Inventor: Wilson Ira Lockett, 7013 Roaring Fork Trail, Boulder, Colo. 80301

[21] Appl. No.: 08/999,065

[22] Filed: Dec. 3, 1997

[51] Int. Cl.[6] ..... A24F 1/16; A24F 13/04; A24F 3/04; A24F 1/04

[52] U.S. Cl. ..... 131/209; 131/210; 131/212.1; 131/338; 131/339

[58] Field of Search ..... 131/201, 209, 131/210, 212.1, 338, 339

[56] References Cited

U.S. PATENT DOCUMENTS

| | | | |
|---|---|---|---|
| 2,033,867 | 3/1936 | Segal | 131/208 |
| 2,462,446 | 2/1949 | Wellborn | 131/339 |
| 2,502,545 | 4/1950 | Wellborn | 131/339 |
| 2,827,903 | 3/1958 | Niederman | 131/339 |
| 2,931,364 | 4/1960 | Mueller | 131/339 |
| 4,492,240 | 1/1985 | Hayes et al. | 131/336 |
| 4,646,762 | 3/1987 | Riehl et al. | 131/336 |

*Primary Examiner*—James Derrington
*Assistant Examiner*—Jacqueline A. Ruller
*Attorney, Agent, or Firm*—Carl M. Wright

[57] ABSTRACT

A filter for passing tobacco smoke or other gaseous material comprising two layers of material having a plurality of circuitous or serpentine passageways forming pathways through which tobacco smoke travels a distance greater than the length of the filter itself. The filter is constructed by coating the layers with an adhesive except in the areas forming the passageways so that when the two layers are fastened together, there are unobstructed paths through the layers of material. The combined layers are rolled into a cylindrical construct. In an alternative embodiment, one or more cavities are formed along the passageways.

1 Claim, 2 Drawing Sheets

SMOKING FILTER

BACKGROUND AND SUMMARY OF THE INVENTION

Smoking tobacco is more pleasant when the tobacco smoke is filtered and cooled. Filters are usually constructed from fibrous products to restrict the size of particles that pass from the tobacco to the smoker.

The invention increases the distance the tobacco smoke travels from the tobacco to the smoker. It can also be constructed of a material that cools the smoke and condenses the moisture therein before it reaches the smoker. The filters can be easily manufactured and the materials used can be recycled instead of being discarded as is the case with present filter materials.

According to the invention, a first layer of material is coated with an adhesive except in a plurality of areas forming passageways having several circuitous or serpentine paths, each having a length greater than the width of the layer material from one edge to the opposite edge, i.e., having a length greater than that of the filter itself.

A second layer of material is arranged similarly to the first layer and is affixed thereto with its described passageways being a mirror image of the passageways of the first layer so as to align to form a plurality of continuous circuitous passages through which the tobacco smoke travels from one end of the material to the other. The affixed layers are rolled into a cylindrical shape to form a smoking filter.

BRIEF DESCRIPTION OF THE DRAWING

The invention is described in detail by referring to the various figures which illustrate specific embodiments of the invention, and wherein like numerals refer to like elements.

DETAILED DESCRIPTION OF THE INVENTION

Figure 1:
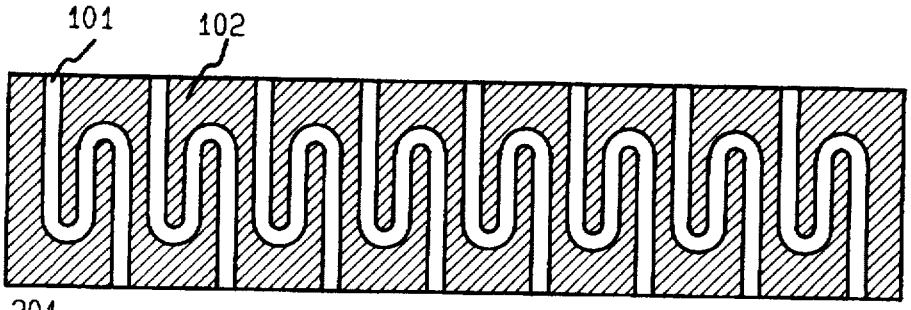
FIG. 1 is an illustration of a layer of a smoking filter according to the invention.
Figure 2:
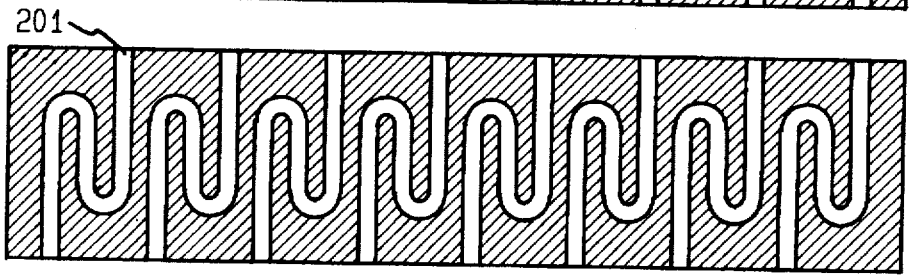
FIG. 2 is an illustration of a matching layer to the layer of FIG. 1.

The basic invention is shown in FIGS. 1 and 2. Two sheets of material, e.g. thin aluminum foil, are described or embossed with several passageways such as 101 in FIG. 1 and matching passageways such as 201 in FIG. 2. The shaded portions, e.g., 102, of the sheets represent a gluing surface on at least one sheet which is coated with an adhesive such as, for example, contact cement. The two sheets are fastened together so that the described or embossed passageways are overlaid such as by folding the sheet of FIG. 1 over onto the sheet of FIG. 2 to form a plurality of continuous serpentine passageways through the combined sheets.

Figure 3:
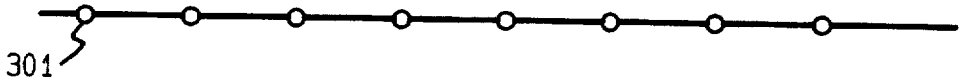
FIG. 3 is an end-on view of the two layers as shown in FIGS. 1 and 2 after being affixed together, showing the openings of the passageways.

FIG. 3 shows the result of affixing the sheets together viewed from the edge. After the two sheets are united, the passageways can be expanded by forcing air into the passageway openings along one edge. This opens the passageways so that tobacco smoke can pass therethrough.

Figure 4:
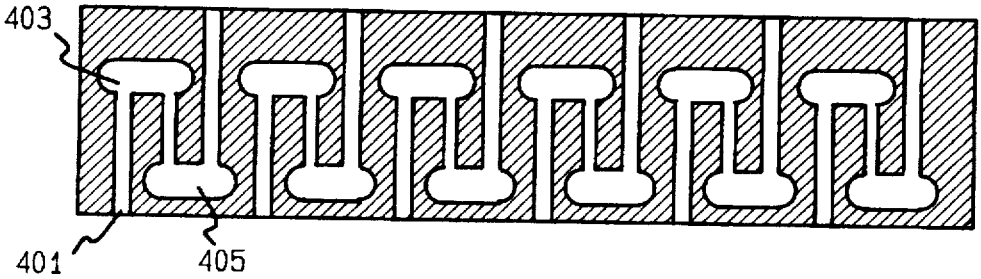
FIG. 4 is an illustration of an alternate embodiment of the invention.

In FIG. 4, only one of a matching pair of sheets is shown with a typical passageway 401. Two cavities 403 and 405 are described or embossed thereon as well as on its matching sheet. These cavities serve to collect moisture or tar or other undesired impurities that accompany the smoke from tobacco products. The expansion of smoke in the cavities cools the tobacco smoke further and enhances condensation.

Figure 5:
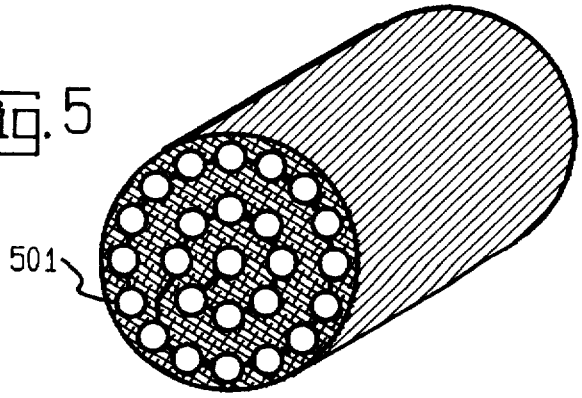
FIG. 5 is an oblique rendition of a completed filter.

The affixed sheets after gluing are rolled as shown in FIG. 5 to form a completed filter. The passageways such as 501 extend through the filter which can be attached to a cigarette or cigar or used in holders for smoking or in pipes.

The illustrations in the drawing are larger than the actual implementation for purposes of illustration and clarity. Furthermore, the number of passageways is greater than those shown for illustrative purposes only. A cigarette filter, for instance, is approximately 5/16-inch in diameter and it is within the ordinary skill in the art to determine the number of passageways that can be included in a typical filter according to the invention.

Furthermore, the number of curves and paths through the passageways is shown as two but it is within the scope of the invention to increase the number of curves and paths to lengthen further the distance that the tobacco smoke travels through the filter. The further the smoke travels through the filter, the better the filtering will be and the more the smoke will be cooled before reaching the smoker.

Both sheets need not be made of the same material. For example, one layer can be a metal foil and the second layer can be an absorbent material such as paper.

Figure 6:
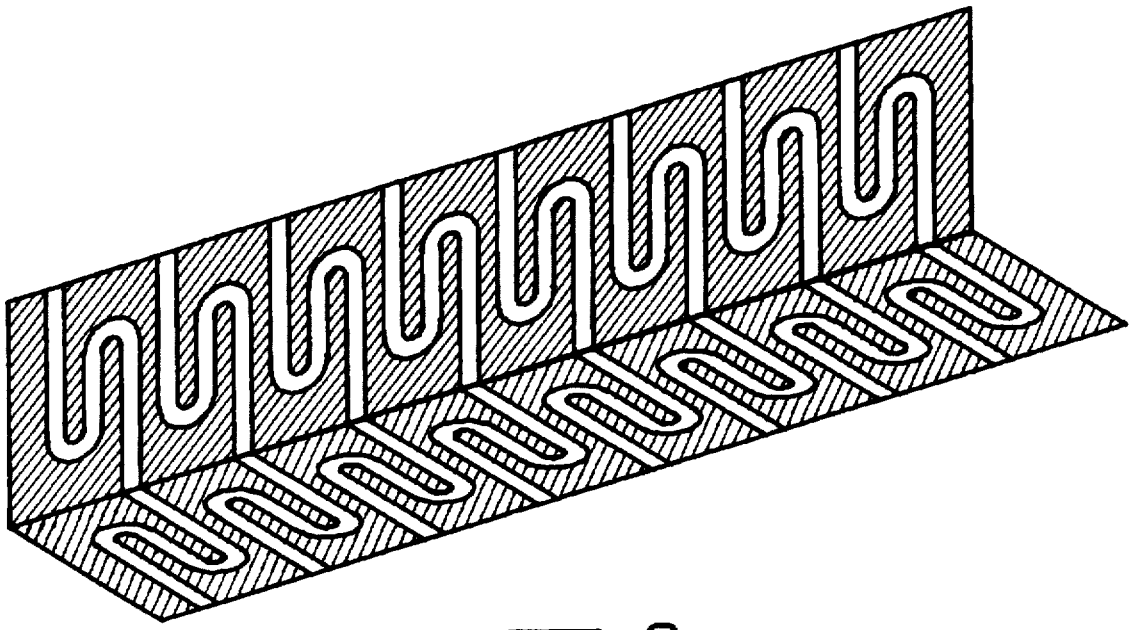
FIG. 6 is an isometric illustration of a step in manufacturing a filter according to the invention.

Alternatively, the layers may be laid out on a common sheet of material and folded over so that the passageways on both sheets coincide as shown in FIG. 6. The folded edge of the sheet can then be trimmed to open the passageways.

While the invention has been particularly shown and described with reference to a preferred embodiment thereof, it will be understood by those skilled in the art that various changes and modifications in form and details may be made therein without departing from the spirit and scope of the invention according to the following claims.

What is claimed is:

1. A device to be placed between tobacco and a smoker for filtering tobacco smoke or other gaseous material, comprising in combination:

a first layer of material coated with an adhesive except in a plurality of areas describing passageways of several circuitous paths each having a length greater than the width of said material from one edge of said width to an opposite edge; and a second layer of material having similar passageways affixed to the first layer, said second sheet having described passageways being a mirror image of the passageways of the first layer so as to align to form a plurality of continuous circuitous passages through which the tobacco smoke travels from one end of the material to the other;

wherein said affixed layers are rolled into a cylindrical shape and wherein said plurality of passageways include at least one cavity larger than the size of the passageways for permitting tobacco smoke passing therethrough to expand whereby said expansion improves condensation and cooling of tobacco smoke.

* * * * *